US012601336B2

(12) United States Patent
Ducote, Jr.

(10) Patent No.: US 12,601,336 B2
(45) Date of Patent: Apr. 14, 2026

(54) CRYOGENIC PUMP

(71) Applicant: Chart Energy & Chemicals, Inc., Ball Ground, GA (US)

(72) Inventor: Douglas A. Ducote, Jr., The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 321 days.

(21) Appl. No.: 17/943,451

(22) Filed: Sep. 13, 2022

(65) Prior Publication Data

US 2023/0093093 A1 Mar. 23, 2023

Related U.S. Application Data

(60) Provisional application No. 63/243,922, filed on Sep. 14, 2021.

(51) Int. Cl.
*F04B 15/08* (2006.01)
*F04B 53/14* (2006.01)

(52) U.S. Cl.
CPC ..... *F04B 15/08* (2013.01); *F04B 53/143* (2013.01); *F04B 53/144* (2013.01)

(58) Field of Classification Search
CPC ..... F04B 15/08; F04B 53/143; F04B 53/144; F04B 53/10; F04B 2015/0822;
(Continued)

(56) References Cited

U.S. PATENT DOCUMENTS 3,531,943 A 10/1970 Parnag et al.
4,227,442 A 10/1980 Oguni et al.
(Continued)

FOREIGN PATENT DOCUMENTS

DE 102008011456 A1 9/2009
EP 2604840 A1 6/2013
WO WO-2011104547 A2 * 9/2011 ..... F04B 51/00

OTHER PUBLICATIONS

International Search Report and Written Opinion, counterpart International App. No. PCT/US2022/043272, (Dec. 6, 2022) (14 pages).

*Primary Examiner* — Joel M Attey
*Assistant Examiner* — Brahim A. Michael Adeniji
(74) *Attorney, Agent, or Firm* — Edell, Shapiro & Finnan, LLC

(57) ABSTRACT

A pump for pumping a cryogenic liquid includes a pump housing having a cylinder with a piston slidably positioned therein. An intermediate fluid chamber that receives an intermediate fluid is defined within the cylinder adjacent to a first end of the piston and a fluid pumping chamber is defined within the cylinder adjacent to a second end of the piston. An intermediate fluid seal is attached to the piston and engages the cylinder. A pumped fluid seal attached to the piston and configured to engage the cylinder, said pumped fluid seal spaced from the intermediate fluid seal so that a differential pressure space is defined within the cylinder between the intermediate fluid and pumped fluid seals. A differential pressure vent valve is in fluid communication with the differential pressure space. A differential pressure switch senses a pressure within the differential pressure space and opens the differential pressure vent valve when the pressure within the differential pressure space reaches a predetermined pressure level.

19 Claims, 3 Drawing Sheets

(58) Field of Classification Search
CPC ..... F04B 23/021; F04B 23/023; F04B 9/109; F04B 9/117; F04B 9/1376; F04B 37/08; F04B 2015/081; F17C 2225/036; F17C 2227/0135; F17C 2227/0142
See application file for complete search history.

(56) References Cited

U.S. PATENT DOCUMENTS 4,432,556 A 2/1984 Green et al.
4,653,986 A * 3/1987 Ashton ..... F04B 9/113 417/268
4,789,313 A 12/1988 Tower et al.
5,317,872 A * 6/1994 Ingvast ..... F15B 21/0423 60/494
6,481,218 B1 11/2002 Dresler
6,530,761 B1 3/2003 Chalk et al.
6,640,556 B2 11/2003 Ursan et al.
6,659,730 B2 12/2003 Gram et al.
6,722,866 B1 4/2004 Dresler
6,912,858 B2 7/2005 White
7,223,080 B2 5/2007 Duron
8,789,379 B2 7/2014 Watts
8,920,538 B2 12/2014 Adler et al.
9,162,410 B2 10/2015 Adler et al.
9,657,680 B2 5/2017 Sumilla et al.
10,024,311 B2 7/2018 Brown et al.
10,330,049 B2 6/2019 Wells
10,443,590 B1 * 10/2019 McCoy ..... F15B 15/1461
10,495,083 B2 * 12/2019 Stockner ..... F04B 53/14
10,519,940 B2 12/2019 Brown et al.
10,626,856 B2 4/2020 Coldren et al.
2001/0026225 A1 * 10/2001 Young ..... G01F 1/38 340/611
2004/0182470 A1 * 9/2004 White ..... F17C 5/00 141/11
2004/0227302 A1 * 11/2004 Burdick ..... F16J 15/004 277/510
2007/0197410 A1 * 8/2007 Placek ..... C10M 145/14 508/469
2009/0064672 A1 * 3/2009 Rafalski, Jr. ..... F01B 1/08 60/413
2010/0126180 A1 5/2010 Forsyth et al.
2012/0132287 A1 * 5/2012 Kreutzkaemper ..... F04B 17/02 417/283
2012/0317995 A1 12/2012 Brunnhofer et al.
2014/0271262 A1 * 9/2014 Frey ..... F04B 15/08 417/302
2016/0208793 A1 7/2016 Kroeger et al.
2018/0347560 A1 12/2018 Stockner et al.
2019/0331298 A1 10/2019 Thor et al.
2023/0067726 A1 * 3/2023 Light ..... F17C 13/025
2023/0071844 A1 * 3/2023 Benistand-Hector ..... F04B 23/023

* cited by examiner

CRYOGENIC PUMP

CLAIM OF PRIORITY

This application claims the benefit of U.S. Provisional Application No. 63/243,922, filed Sep. 14, 2021, the contents of which are hereby incorporated by reference.

FIELD OF THE DISCLOSURE

The present invention relates generally to pumps for cryogenic liquids and, more particularly, to a cryogenic pump that uses an intermediate fluid and reduces differential pressures across the pump seals.

BACKGROUND OF THE INVENTION

Cryogenic fluids, such as liquid natural gas and hydrogen, are fluids that have boiling points below −130° F./−90° C. Cryogenic fluids are increasing in importance as energy sources and also have many important industrial uses.

For example, hydrogen has grown in importance as an alternative clean energy source as advances are being made in fuel cell technology and the use of hydrogen in home power generation. In addition, use of fuel cell technology, such as in fuel cell powered vehicles, is growing.

As in the case of other cryogenic fluids, such as liquid natural gas, hydrogen is transported and stored more efficiently in liquid form. Furthermore, it is desirable to store hydrogen at high density and to transport and use hydrogen in a reduced volume and at a low cost to aid in the establishment of a practical hydrogen infrastructure. In addition, it is often necessary to pressurize other cryogenic liquids for use and transport as well as efficient storage. Cryogenic pumps are therefore critical components in the storage and transport of cryogenic liquids.

Cryogenic pump seals, particularly in high pressure applications, are prone to leakage which is detrimental to the performance of cryogenic pumps.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a pump for pumping a cryogenic liquid includes a pump housing defining a cylinder. A piston is slidably positioned within the cylinder so that an intermediate fluid chamber that is configured to receive an intermediate fluid is defined within the cylinder adjacent to a first end of the piston and a fluid pumping chamber is defined within the cylinder adjacent to a second end of the piston. The fluid pumping chamber includes an inlet and an outlet. An intermediate fluid seal is attached to the piston and is configured to engage the cylinder. A pumped fluid seal is also attached to the piston and configured to engage the cylinder. The pumped fluid seal is spaced from the intermediate fluid seal so that a differential pressure space is defined within the cylinder between the intermediate fluid and pumped fluid seals. A differential pressure vent valve is in fluid communication with the differential pressure space. A differential pressure switch is operatively connected to the differential pressure vent valve and configured to sense a pressure within the differential pressure space and open the differential pressure vent valve when the pressure within the differential pressure space reaches a predetermined pressure level.

In another aspect, a method for pumping a cryogenic liquid includes the steps of providing a pump having a piston slidably positioned within the cylinder and defining an intermediate fluid chamber and a fluid pumping chamber, an intermediate fluid seal and a pumped fluid seal so that a differential pressure space is defined between the intermediate and pumped fluid seals, actuating the piston by cyclically directing an intermediate fluid to the intermediate fluid chamber of the pump so that the cryogenic liquid is received and pumped by the fluid pumping chamber of the pump, detecting a pressure of the differential pressure space and venting the differential pressure space when the detected pressure reaches a predetermined pressure level.

DETAILED DESCRIPTION OF EMBODIMENTS

It should be noted that while the embodiments illustrated and presented below are described in terms of pumping liquid hydrogen, the invention may be used to pump other types of cryogenic liquids.

Figure 1:
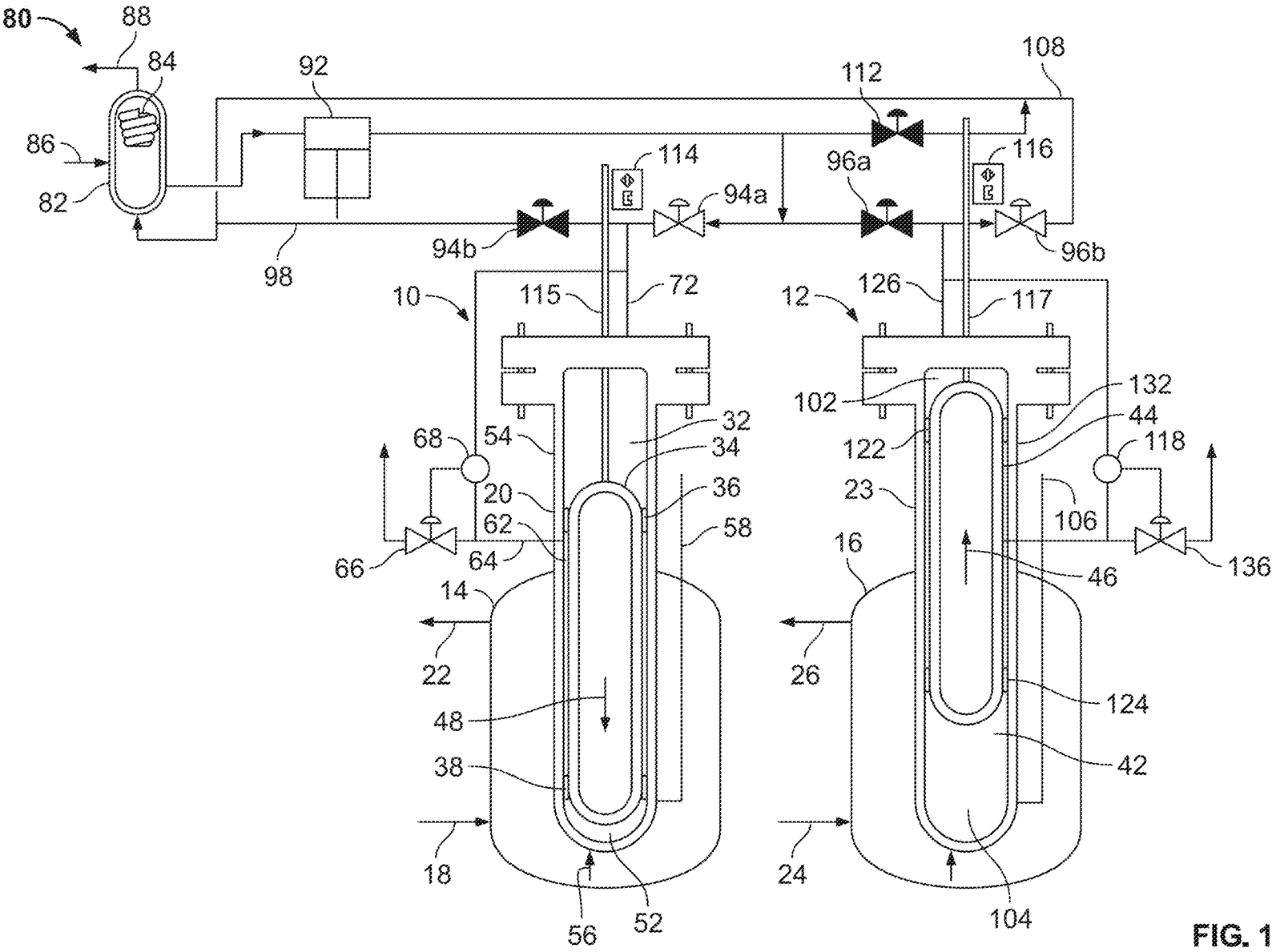
FIG. 1 is a process flow and schematic illustrating a system including an embodiment of the cryogenic pump of the disclosure.

A system for pumping liquid hydrogen to a high pressure is illustrated in FIG. 1. As an example only, the system may pump the liquid hydrogen to approximately 1000 bar. The system includes a first cryogenic pump, indicated in general at 10, and a second cryogenic pump, indicated in general at 12. As will be described in greater detail below, the pumps 10 and 12 are driven by an intermediate fluid, such as propane, 1-butene or other fluids known in the art. While two cryogenic pumps are illustrated, the system may include a single cryogenic pump or more than two cryogenic pumps.

The embodiment of FIG. 1 uses propane as an intermediate fluid to drive pumps 10 and 12. Propane may be maintained as a liquid at reasonably warm temperatures (~−14° F.) and therefore low pressure. The liquid hydrogen is at ~−415° F. As explained in greater detail below, a frac style pump may be used to pump the propane to very high pressure (1000 bar=14,500 psi). The high-pressure propane drives the pistons of pumps 10 and 12 to pump the liquid hydrogen to near 1000 bar. Use of the intermediate fluid reduces seal issues and the differential pressure across the seals may be kept to a minimum. As a result, hydrogen seal leakage and friction, both of which are detrimental to the hydrogen pump overall performance, may be reduced.

Fluids other than propane, including but not limited to 1-butene, may alternatively be used as the intermediate fluid to drive pumps 10 and 12.

With reference to FIG. 1, cryogenic pumps 10 and 12 are positioned in corresponding sumps 14 and 16, respectively. Sump 14 includes a hydrogen liquid inlet 18 through which liquid hydrogen flows into the sump so that the bottom portion of the housing 20 of pump 10 is submerged. As a result, pump 10 is kept cool by the liquid hydrogen so that vapor formation within the pump 10 during pumping is eliminated (or at least minimized). Sump 14 also includes a liquid hydrogen outlet 22 so that liquid hydrogen may be returned to the source to provide recirculation of liquid hydrogen through the sump 14 (such as when the pump is idle and not in use). Sump 16 similarly features a pump housing 23, hydrogen liquid inlet 24 and hydrogen liquid outlet 26.

The pump housing 20 of pump 10 defines a cylinder 32 within which a piston 34 is slidingly disposed. The piston includes an intermediate fluid or propane seal 36 and a pumped fluid or hydrogen seal 38. The pump housing 23 of pump 12 similarly defines a cylinder 42 that contains piston 44. The pistons 34 and 44 of pumps 10 and 12, respectively, move between a bottom dead center position, illustrated by pump 10 in FIG. 1, and a top dead center position, illustrated by pump 12 in FIG. 1. The piston of each pump moves in an upstroke or hydrogen intake direction, indicated by arrow 46 for pump 12 in FIG. 1, when moving from the bottom dead center to the top dead center positions, and in a downstroke or hydrogen discharge direction, indicated by arrow 48 for pump 10 in FIG. 1, when moving from the top dead center to the bottom dead center positions.

The piston 34 divides the cylinder 32 of pump 10 into a pumping chamber 52 and an intermediate fluid chamber 54. A pumping inlet, indicated by arrow 56 in FIG. 1 for pump 10, is formed in the pumping chamber 52 so that liquid hydrogen from the sump 14 enters the pumping chamber during the upstroke of piston 34. The liquid hydrogen within the pumping chamber 52 exits the pumping chamber through the pump discharge line 58 during the downstroke of piston 34. As an example only, the liquid hydrogen may exit pump 10 through pump discharge line 58 at a pressure of approximately 1000 bar to a liquid hydrogen storage tank or process. Pump 12 features a similar construction and functionality.

With continued reference to FIG. 1, an annular differential pressure ("dP") space 62 of pump 10 is defined between the sidewall of piston 34, the intermediate fluid seal, the pumped fluid seal and the inner surface of the pump housing 34. The annular dP space 62 is connected to a vent line 64 having a dP vent valve 66 controlled by a dP switch 68, which opens and closes based on the difference between the pressure within the annular dP space and the intermediate fluid pressure within an intermediate fluid pump line 72.

The pressure in the annular dP space may be measured via the vent line 64 (as shown in FIG. 1) or via a dedicated connection between the dP switch 68 and the annular dP space. In addition, the pressure of the intermediate fluid may alternatively be detected by the dP switch 68 via a fluid connection with the intermediate fluid chamber 54 (instead of line 72). Pump 12 features a similar construction and functionality. The dP switch 68 may be a switch that senses pressure or could alternatively include a pressure sensor or controller that senses pressure and a separate switch that is activated based on the pressure sensed by the sensor or controller.

The cryogenic pumps 10 and 12 of FIG. 1 are driven by a drive system such as an intermediate fluid circuit, indicated in general at 80. The intermediate fluid circuit includes a cooling vessel 82 containing a refrigeration coil 84. The cooling vessel 82 may be refilled with propane via line 86 and is likewise provided with a vent line 88 to accommodate filling with liquid propane. As is known in the art, the vent line 88 may be provided with a vent valve that automatically opens when a pressure within the cooling vessel 82 reaches a predetermined level.

The refrigeration coil 84 receives refrigerant from a refrigeration system or other source and cools the propane within the cooling vessel 82. The refrigeration system and coil 84 are preferably configured to cool the propane within the cooling vessel to a temperature corresponding to a pressure lower than the pressure within the hydrogen sump 14 (or 16).

Liquid propane from the cooling vessel 82 is pumped via one or more high pressure intermediate fluid pumps 92 to cryogenic pump actuation valves 94*a* and 94*b* for pump 10 and pump actuation valves 96*a* and 96*b* for pump 12. As an example only, the high pressure pump(s) 92 may be, a frac style pump that pumps the propane to very high pressure, such as 1000 bar. Alternative high pressure pumps known in the art may alternatively be used.

Starting with the pistons 34 and 44 of pumps 10 and 12 in the positions illustrated in FIG. 1 (i.e. bottom dead center and top dead center), actuation valve 94*a* is closed and actuation valve 94*b* is open. As a result, as piston 34 moves in its upstroke or intake direction (opposite the direction of arrow 48 in FIG. 1), liquid propane within the intermediate fluid chamber 54 is directed through valve 94*b* back to the cooling vessel 82 through recirculation line 98. Meanwhile, actuation valve 96*a* is open and actuation valve 96*b* is closed so that pressurized propane from high pressure intermediate fluid pump(s) 92 is supplied to the intermediate fluid chamber 102 of cryogenic pump 12. As a result, piston 44 is driven in its downstroke or hydrogen discharge direction (opposition the direction of arrow 46 in FIG. 1) so as to force/pump the liquid hydrogen within the pumping chamber 104 of pump 12 through the cryogenic pump discharge line 106 to liquid hydrogen storage or a process. When piston 34 reaches top dead center and piston 44 reaches bottom dead center, actuation valves 94*a* and 96*b* open while actuation valves 94*b* and 96*a* close so that pressurized liquid propane may be directed from intermediate fluid pump(s) 92 into intermediate fluid chamber 54 of pump 10 while liquid propane is driven to the cooling vessel 82 from the intermediate fluid chamber 102 of pump 12 via recirculation line 108.

The cycle of the previous paragraph is repeated so that cryogenic pumps 10 and 12 are driven by intermediate fluid delivered to the pumps in a cyclical fashion while liquid hydrogen is pumped at high pressure in a cyclical fashion through pump discharge lines 58 and 106 during the downstroke/discharge stroke of pumps 10 and 12. As this occurs, intermediate fluid/propane is driven back, in a cyclical fashion through recycle lines 98 and 108, to the cooling vessel 82 during the upstroke/intake strokes of pumps 10 and 12.

A high pressure recirculation valve 112 is also in fluid communication with the outlet of the intermediate fluid pump(s) 92. The high pressure recirculation valve 112 temporarily opens when a piston bottoms out/reaches bottom dead center in each of cryogenic pumps 10 and 12 to prevent over pressure of the system as the corresponding piston transitions to movement in an upstroke/intake direction. The propane flow from intermediate fluid pump(s) 92 that is not directed to the actuation valves is directed back to the cooling vessel 82 through recirculation line 108 (although a dedicated return line may be used) when valve 112 is open.

The propane flow pressure is set by the actuation valves 94*a*, 94*b*, 96*a* and 96*b* and is determined by the pressure needed to force the pistons of pumps 10 and 12 to get to 1000 bar hydrogen pressure to pump the liquid hydrogen to storage or a process.

Alternative drive systems known in the art may be used in place of the intermediate fluid circuit 80 of FIG. 1 to drive the cryogenic pumps 10 and 12 using the intermediate fluid.

Optional proximity switches 114 and 116 may be used in combination with piston position rods 115 and 117 to indicate the positions of the pistons 34 and 44 of cryogenic pumps 10 and 12. These switches may be used to control the rate of intermediate fluid flow and the speeds of the pistons and to ensure that the pistons can bottom out in the cylinders without damage to minimize the clearance volume in the pumps.

The intermediate fluid seals 36 and 122 and the pumped fluid seals 38 and 124 normally keep the annular dP space 62 of pump 10 and the annular dP space 132 of pump 12 free of hydrogen and propane.

The dP switches 68 of pump 10 and 118 of pump 12 are set to prevent propane intermediate fluid leaking into the liquid hydrogen and liquid hydrogen from leaking into the propane intermediate fluid, and in all cases to reduce the differential pressures across the intermediate fluid seals 36, 122 and the pumped fluid seals 38, 124, preferably to a minimum.

In the embodiment of FIG. 1, the pressure setting of dP switch 68 and 118 of each cryogenic pump 10 and 12 is slightly less that the intermediate fluid pressure (as measured through intermediate fluid pump lines 72 and 126) to prevent intermediate fluid from leaking into the hydrogen product on the downstroke (arrow 48), where the intermediate fluid pressure must be higher than the hydrogen sump pressure. This pressure setting for each dP switch also prevents hydrogen from leaking into the intermediate fluid on the upstroke (arrow 46), where the hydrogen sump pressure must be higher than the intermediate fluid pressure.

In operation, with reference to cryogenic pump 10 of FIG. 1, during the piston downstroke, which is being completed by pump 10, the pressure of the propane must be higher than the pressure in the hydrogen sump (to drive the piston 34 and pump the hydrogen). Propane may therefore potentially leak into the annular dP space 62 through intermediate fluid seal 36. The dP switch 68 will control the vent valve 66 so that the pressure in the annular dP space 62 is slightly less than the intermediate fluid/propane pressure, which will also be less than the pressure of the hydrogen in the sump 14 and pumping chamber 52 as it is being pumped. As a result, propane leaked into the annular dP space 62 will be driven out open dP vent valve 66 instead of through seal 38 and into the liquid hydrogen if the pressure in the annular dP space 62 rises to a level just below the pressure of the propane in the intermediate fluid chamber 54 (and line 72). The propane exiting the open dP vent valve 66 may be vented or recovered for use, such as in the intermediate fluid circuit 80.

Conversely, with reference to cryogenic pump 12, during the piston upstroke, which is being completed by pump 12, the pressure of the hydrogen in the pumping chamber 104 of pump 12 will be higher than the intermediate fluid pressure in the intermediate fluid chamber 102 (and line 126). As a result, hydrogen may leak into the annular dP space 132 through pumped fluid seal 124. As in the case of pump 10, dP switch 118 will control the dP vent valve 136 so that the pressure in the annular dP space 132 is slightly less than the intermediate fluid/propane pressure. As a result, hydrogen leaked into the annular dP space 132 will be driven out open dP vent valve 136 instead of through seal 122 and into the propane intermediate fluid if the pressure in the annular dP space 122 rises to a level just below the pressure of the propane in the intermediate fluid chamber 102 (and line 126). The hydrogen exiting the open dP vent valve 136 may be vented or recovered for use, such as in the system supplying hydrogen to sumps 14 and 16.

Pump 10 then operates as described above for pump 12 during its upstroke stage while pump 12 then operates as described above for pump 10 during its downstroke stage, with the pumps 10 and 12 cycling through stages as liquid hydrogen is pumped.

Figure 2:
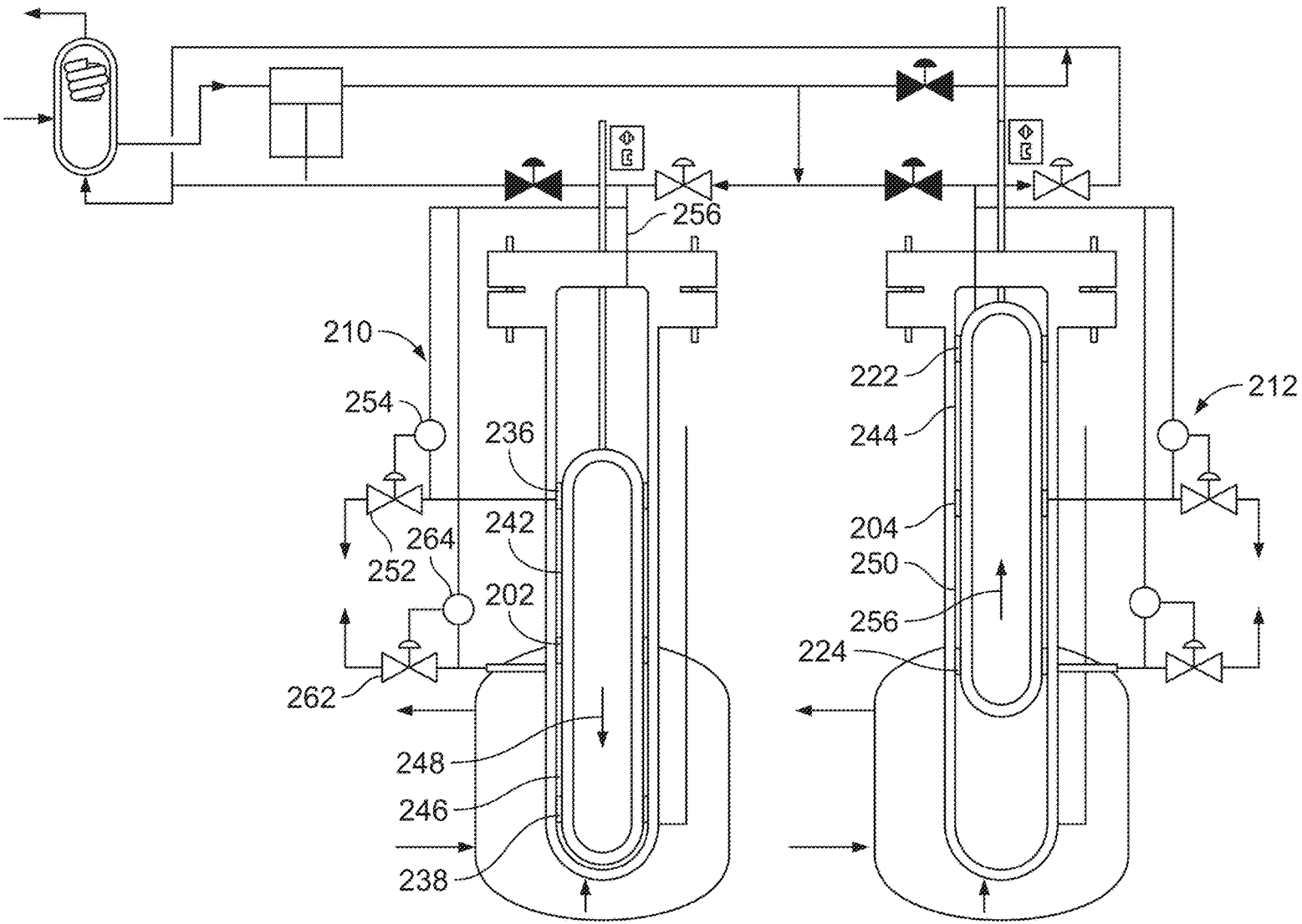
FIG. 2 is a process flow and schematic illustrating a system including an alternative embodiment of the cryogenic pump of the disclosure.

As illustrated in FIG. 2, one or more optional supplemental seals 202 and 204 may be used to separate leaked intermediate fluid from leaked hydrogen between the intermediate fluid seal 236 and the pumped fluid seal 238 of cryogenic pump 210 and the intermediate fluid seal 222 and the pumped fluid seal 224 of pump 212. As illustrated in FIG. 2, the supplemental seals 202 and 204 divide the annular dP spaces of pumps 210 and 212 into intermediate fluid annular dP spaces 242 and 244 and pumped fluid dP spaces 246 and 250. Either dP annular space of each of pumps 210 and 212, or both dP annular spaces of each pump, may be provided with the dP switch and dP vent valve arrangement described above with reference to FIG. 1.

An embodiment where dedicated dP switches and dP valves is also illustrated in FIG. 2. More specifically, as noted previously, cryogenic pump 210 includes intermediate fluid annular dP space 242 and pumped fluid dP space 246. An intermediate fluid dP vent valve 252 is in fluid communication with the intermediate fluid annular dP space 242. The intermediate fluid dP vent valve 252 is controlled by an intermediate fluid dP switch 254, which opens and closes based on the difference between the pressure within the intermediate fluid annular dP space 242 and the pressure within an intermediate fluid pump line 256. Cryogenic pump 212 features a similar arrangement.

Similarly, a pumped fluid dP vent valve 262 is in fluid communication with the pumped fluid annular dP space 246. The pumped fluid dP vent valve 262 is controlled by a pumped fluid dP switch 264, which opens and closes based on the difference between the pressure within the pumped fluid annular dP space 246 and the pressure within the intermediate fluid pump line 256. Cryogenic pump 212 features a similar arrangement.

As in the embodiment of FIG. 1, the settings of the dP switches 254 and 264 of FIG. 2 (and the corresponding dP switches of pump 212) are slightly less that the intermediate fluid pressure (as measured through intermediate fluid pump line 256) to prevent intermediate fluid from leaking into the hydrogen product on the downstroke (shown by arrow 248 of pump 210), where the intermediate fluid pressure must be higher than the hydrogen storage pressure. This pressure setting for each dP switch also prevents hydrogen from leaking into the intermediate fluid on the upstroke (shown by arrow 256 of pump 212), where the hydrogen sump pressure must be higher than the intermediate fluid pressure.

Figure 3:
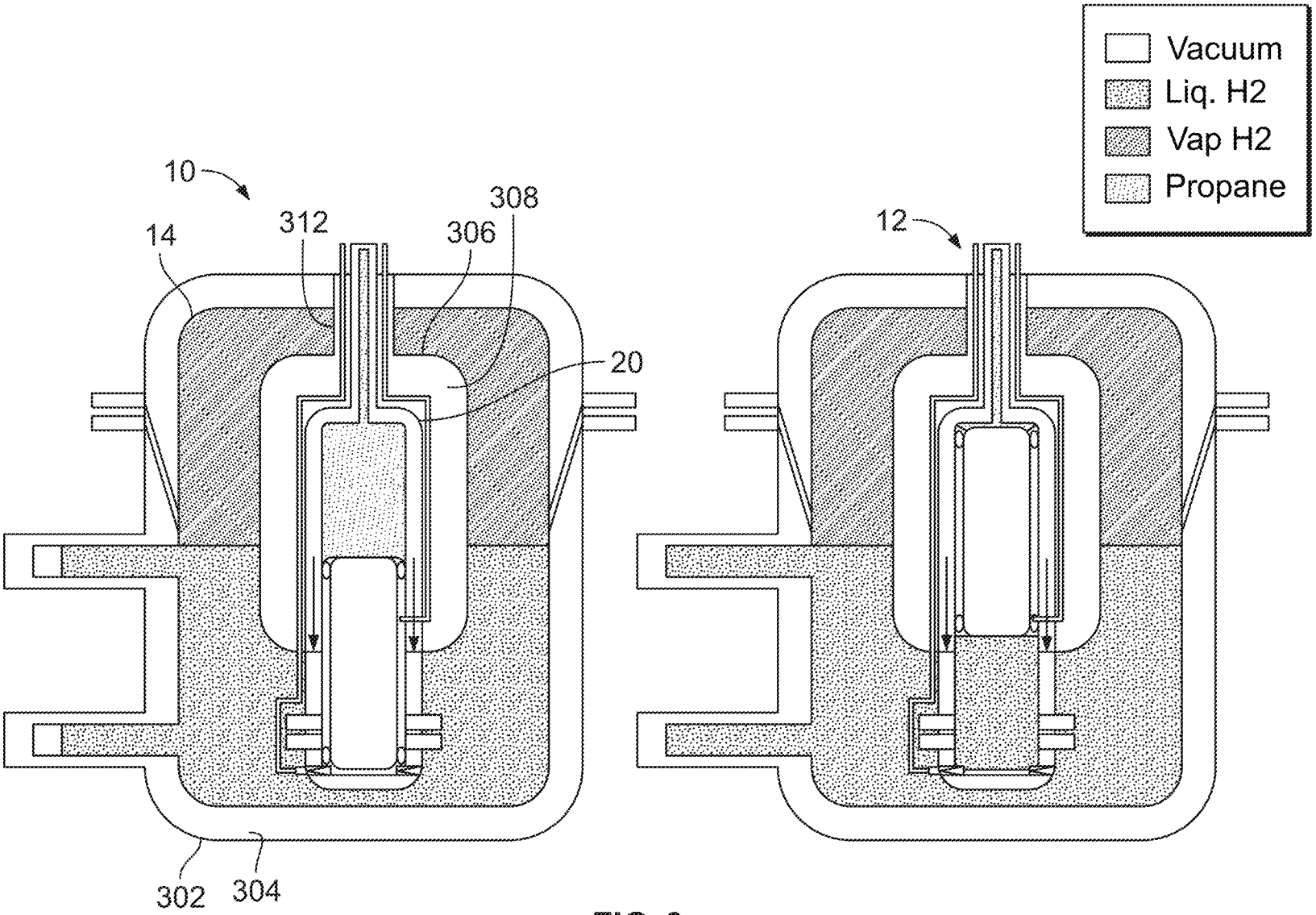
FIG. 3 illustrates an embodiment of an insulation system that may be used for the cryogenic pumps of the systems of FIGS. 1 and 2.

The cryogenic pumps 10 and 12 of FIG. 1, or the cryogenic pumps 210 and 212 of FIG. 2, may be insulated as shown in an insulation embodiment illustrated in FIG. 3. As shown for pump 10, a sump jacket 302 is formed around the sump 14 so that a vacuum space 304 is provided. In addition, a pump jacket 306 is provided around the pump housing 20 so that vacuum space 308 is formed. Vacuum spaces 304 and 308 may be joined by a neck jacket 312. The neck jacket 312 may be used to suspend the pump jacket within the sump and defines a vacuum space that may be open with respect to vacuum spaces 304 and 308. The neck jacket 312 may also surround the structure used to suspend the pump housing 20 within the sump as well as the piston position rod 115 (FIG. 1). Pump 12 features similar insulation.

There are several aspects of the present subject matter which may be embodied separately or together in the methods, devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

While the preferred embodiments of the invention have been shown and described, it will be apparent to those skilled in the art that changes and modifications may be made therein without departing from the spirit of the invention, the scope of which is defined by the appended claims.

What is claimed is:

1. A pump for pumping a cryogenic liquid comprising:

a. a pump housing defining a cylinder;

b. a piston slidably positioned within the cylinder so that an intermediate fluid chamber that is configured to receive an intermediate fluid is defined within the cylinder adjacent to a first end of the piston and a fluid pumping chamber is defined within the cylinder adjacent to a second end of the piston, said fluid pumping chamber including an inlet and an outlet;

c. an intermediate fluid seal attached to the piston and configured to engage the cylinder;

d. a pumped fluid seal attached to the piston and configured to engage the cylinder, said pumped fluid seal spaced from the intermediate fluid seal so that a differential pressure space is defined within the cylinder between the intermediate fluid and pumped fluid seals;

e. a differential pressure vent valve in fluid communication with the differential pressure space;

f. a differential pressure switch operatively connected to the differential pressure vent valve and configured to sense a pressure within the differential pressure space and a pressure within the intermediate fluid chamber, compare the pressures sensed in the differential pressure space and the intermediate fluid chamber and to open the differential pressure vent valve when the pressure within the differential pressure space reaches a predetermined pressure level that is below a pressure of the intermediate fluid within the intermediate fluid chamber.

2. The pump of claim 1 further comprising a sump within which a portion of the pump housing is positioned, said sump configured to receive and submerge the portion of the pump housing within the cryogenic liquid and to provide cryogenic liquid to the inlet of the pumping chamber for pumping.

3. The pump of claim 1 further comprising a supplemental seal attached to the piston between the intermediate fluid seal and the pumped fluid seal so that the differential pressure space is divided into an intermediate fluid differential pressure space and a pumped fluid differential pressure space.

4. The pump of claim 3 wherein the differential pressure vent valve includes an intermediate fluid vent valve in fluid communication with the intermediate fluid differential pressure space and a pumped fluid vent valve in fluid communication with the pumped fluid differential pressure space and the differential pressure switch includes an intermediate fluid differential pressure switch operatively connected to the intermediate fluid differential pressure vent valve and a pumped fluid differential pressure switch operatively connected to the pumped fluid differential pressure vent valve, said intermediate pressure differential pressure switch configured to sense a pressure within the intermediate fluid differential pressure space and to open the intermediate fluid differential pressure vent valve when the pressure within the intermediate fluid differential pressure space reaches a first predetermined pressure level and said pumped fluid pressure differential pressure switch configured to sense a pressure within the pumped fluid differential pressure space and to open the pumped fluid differential pressure vent valve when the pressure within the pumped fluid differential pressure space reaches a second predetermined pressure level.

5. The pump of claim 4 wherein the first and second predetermined pressure levels are below a pressure of the intermediate fluid within the intermediate fluid chamber.

6. The pump of claim 1 wherein the differential pressure space is an annular space.

7. The pump of claim 1 further comprising a drive system for cyclically providing the intermediate fluid to the intermediate fluid chamber so that the piston is actuated to pump the cryogenic liquid from the pumping chamber.

8. The pump of claim 7 wherein the drive system includes:

i) an intermediate fluid vessel configured to contain a supply of the intermediate fluid;

ii) a high pressure pump configured to receive and pump h intermediate fluid from the intermediate fluid vessel;

iii) a first actuation valve configured to receive h intermediate fluid from the high pressure pump and to direct h intermediate fluid to the intermediate fluid chamber of the pump cylinder when in an open configuration;

iv) a second actuation valve configured to receive h intermediate fluid from the intermediate fluid chamber of the pump cylinder and to direct the intermediate fluid to the intermediate fluid vessel when in an open configuration.

9. The pump of claim 8 wherein the drive system further includes a high pressure recirculation valve configured to direct the intermediate fluid flow from the high pressure pump to the intermediate fluid vessel when in an open configuration.

10. The pump of claim 8 wherein the intermediate fluid vessel includes a refrigeration coil configured to cool the supply of the intermediate fluid within the intermediate fluid vessel.

11. The pump of claim 1 further comprising proximity switches operatively coupled to the piston and configured so that positions of the piston may be detected.

12. The pump of claim 1 wherein the cryogenic liquid is hydrogen liquid.

13. The pump of claim 1 wherein the intermediate fluid is propane.

14. The pump of claim 1 wherein the intermediate fluid is 1-butene.

15. The pump of claim 1 further comprising:

g. a sump within which a portion of the pump housing is position, said sump configured to receive and submerge the portion of the pump housing within the cryogenic liquid and to provide cryogenic liquid to the inlet of the pumping chamber for pumping;

h. a sump jacket surrounding said sump so that a sump insulation space is defined therebetween;

i. a pump jacket surrounding said pump housing so that a pump insulation space is defined therebetween.

16. The pump of claim 1 wherein the differential pressure vent valve is in fluid communication with the differential pressure space via a vent line and the differential pressure switch senses a pressure within the differential pressure space via the vent line.

17. The pump of claim 1 wherein the differential pressure switch senses a pressure within the differential pressure space via a dedicated connection between differential pressure switch and the differential pressure space.

18. The pump of claim 1 wherein the intermediate fluid chamber receives an intermediate fluid via an intermediate fluid pump line and the differential pressure switch senses a pressure within the intermediate fluid chamber via the intermediate fluid pump line.

19. The pump of claim 1 wherein the differential pressure switch senses a pressure within the intermediate fluid chamber via a fluid connection between the differential pressure switch and the intermediate fluid chamber.

* * * * *